US009789687B2

(12) United States Patent
Kozuki

(10) Patent No.: US 9,789,687 B2
(45) Date of Patent: Oct. 17, 2017

(54) INK JET HEAD HAVING GROUNDED PROTECTION PLATE ON EJECTION FACE OF NOZZLE PLATE AND LIQUID JET RECORDING APPARATUS INCORPORATING SAME

(71) Applicant: SII PRINTEK INC., Chiba-shi, Chiba (JP)

(72) Inventor: Atsushi Kozuki, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 15/245,655

(22) Filed: Aug. 24, 2016

(65) Prior Publication Data

US 2017/0057229 A1 Mar. 2, 2017

(30) Foreign Application Priority Data

Aug. 27, 2015 (JP) ..... 2015-168241

(51) Int. Cl.
*B41J 2/14* (2006.01)
*B41J 2/16* (2006.01)

(52) U.S. Cl.
CPC ..... *B41J 2/1433* (2013.01); *B41J 2/14209* (2013.01)

(58) Field of Classification Search
CPC ..... B41J 2/1433
See application file for complete search history.

(56) References Cited

U.S. PATENT DOCUMENTS

2007/0182788 A1* 8/2007 Tanuma ..... B41J 2/14 347/62
2014/0063131 A1 3/2014 Arai et al. ..... 347/71

FOREIGN PATENT DOCUMENTS

| | | |
|---|---|---|
| EP | 0528440 | 2/1993 |
| EP | 2133204 | 12/2009 |
| JP | 2010143106 | 7/2010 |
| JP | 2011143573 | 7/2011 |

* cited by examiner

*Primary Examiner* — Juanita D Jackson
(74) *Attorney, Agent, or Firm* — Adams & Wilks

(57) ABSTRACT

An exposure portion which exposes a protection plate is formed on a back face of a nozzle plate at a part of a position other than an actuator joining face of the nozzle plate.

5 Claims, 8 Drawing Sheets

INK JET HEAD HAVING GROUNDED PROTECTION PLATE ON EJECTION FACE OF NOZZLE PLATE AND LIQUID JET RECORDING APPARATUS INCORPORATING SAME

BACKGROUND

Technical Field

The present invention relates to an ink jet head and a liquid jet recording apparatus.

Related Art

A liquid jet recording apparatus, for example, an ink jet printer which performs various kinds of printing operations is typically provided with a conveyance device which conveys a recording medium and an ink jet head. The ink jet head used in the ink jet printer performs recording in such a manner that ink is supplied to the ink jet head from an ink tank through an ink supply tube, and the ink is ejected onto a recording medium through a nozzle hole of a head chip disposed on the ink jet head.

The above head chip is provided with a nozzle plate which includes a nozzle array consisting of a plurality of nozzle holes and an actuator plate which is joined to the nozzle plate and includes a plurality of channels communicating with the nozzle holes. The actuator plate is filled with ink.

Further, electrodes are formed on walls which define the channels of the actuator plate. The walls are deformed by applying voltage to the electrodes, which produces pressure fluctuation in ink inside the channels. Accordingly, the ink is ejected through the nozzle holes of the nozzle plate.

A protection plate may be disposed on an ink ejection face of the nozzle plate to protect the ejection face of the nozzle plate or reduce thermal deformation of the nozzle holes. The protection plate is formed of a metal plate to ensure stiffness. Thus, the protection plate may be charged, for example, by rubbing against a recording medium. The charge of the protection plate affects the ink ejection characteristics, for example, changes the ejection direction of ink droplets.

Thus, a technique is known that uses a nozzle plate formed of silicon, provides a conductive terminal on the surface of the nozzle plate, and grounds the conductive terminal on a housing. Further, since the nozzle plate is formed of silicon in this technique, the surface of the nozzle plate is coated with a liquid droplet protection film to prevent erosion of the nozzle plate caused by ink (refer to JP 2010-143106 A, for example).

Further, a technique is known that provides a conductive portion which penetrates a nozzle plate in the thickness direction at a position facing an ink chamber (common ink chamber) and provides a conductive cover portion on the nozzle plate at a side opposite to the ink chamber. The conductive cover portion is in contact with the conductive portion and also in contact with a housing. Accordingly, the nozzle plate can be grounded through the conductive portion and the conductive cover portion (refer to JP 2011-143573 A, for example).

However, in JP 2010-143106 A, it is necessary to route the conductive terminal to connect the conductive terminal to the housing. Thus, steps of forming the conductive terminal become complicated. Further, since the nozzle plate is formed of silicon, the liquid droplet protection film is required to prevent erosion of the silicon caused by ink. Thus, the number of steps and the manufacturing cost for manufacturing the nozzle plate disadvantageously increase.

In JP 2011-143573, the conductive portion is exposed also in the ink chamber. Thus, electricity flows through ink and a short circuit occurs when the actuator plate is driven. Accordingly, the operation of the ink jet head disadvantageously becomes unstable.

Further, it is necessary to provide the conductive cover portion to ground the conductive portion. Thus, disadvantageously, the number of components increases, and the size of the ink jet head increases.

SUMMARY

The present invention has been made in view of the above circumstances, and provides an ink jet head and a liquid jet recording apparatus that make it possible to remove static charges while reducing increases in the number of manufacturing steps and the manufacturing cost with a simple structure.

Further, the present invention provides an ink jet head and a liquid jet recording apparatus that make it possible to stabilize the operation, reduce an increase in the number of components, and achieve downsizing.

To solve the problem described above, an ink jet head according to the present invention includes: a nozzle plate including a nozzle array consisting of a plurality of nozzle holes; an actuator plate filled with ink, the actuator plate including a plurality of channels communicating with the nozzle holes; and a protection plate disposed on an ejection face of the nozzle plate from which the ink is ejected, the protection plate including through holes formed at positions corresponding to the nozzle holes, the through holes communicating with the nozzle holes, wherein an exposure portion configured to expose the protection plate is formed on a back face of the nozzle plate, the back face being located opposite to the ejection face, at a part of a position that other than a joining face of the nozzle plate with the actuator plate.

Such a configuration enables a portion for grounding (a portion on which the protection plate is grounded) to be provided on the back face of the nozzle plate with a simple structure. That is, the protection plate can be grounded on the back face side of the nozzle plate through the exposure portion. Further, since grounding of the nozzle plate itself is not required, it is not necessary to form the nozzle plate using silicon as conventionally performed. Thus, it is possible to remove static charges from the nozzle plate while reducing increases in the number of manufacturing steps and the manufacturing cost.

Further, the grounding is performed using the back face side of the nozzle plate. Thus, a cover made of metal for covering the ink jet head is not required, and the size of the nozzle plate itself is not increased. Further, ink is not uniformly adhered to the portion for grounding (the portion in which the protection plate is exposed on the back face side of the nozzle plate). Thus, no short circuit occurs when the actuator plate is driven. Accordingly, it is possible to stabilize the operation of the ink jet head and reduce an increase in the number of components to downsize the ink jet head.

In the ink jet head according to the present invention, the nozzle plate and the protection plate are formed in a rectangular shape elongated along the nozzle array, and the exposure portion is formed on a longitudinal end of the nozzle plate.

Such a configuration enables the nozzle plate to be thinned in the short-side direction. As a result, even when a plurality of ink jet heads are arranged side by side along the short-side direction of the nozzle plate, the ink jet heads can be fitted within a reduced space.

The longitudinal end is more easily bent than the short-side end. Thus, the protection plate can be easily grounded using the easiness in bending.

In the ink jet head according to the present invention, the nozzle plate and the protection plate are formed in a rectangular shape elongated along the nozzle array, the actuator plate is formed in a rectangular parallelepiped shape, the channels are open on a first face of the actuator plate to which the nozzle plate is joined and open on a second face intersecting the first face, a cover plate configured to partially block openings of the channels and including an ink introduction portion communicating with the channels is disposed on the second face of the actuator plate, and the exposure portion is formed on a short-side end of the nozzle plate at a side corresponding to the cover plate.

Such a configuration enables the grounding portion to be separated from the actuator plate as much as possible even in the short-side direction of the nozzle plate. Thus, even when grounding is performed in the short-side direction of the nozzle plate, the operation of the actuator plate can be stabilized.

In the ink jet head according to the present invention, the actuator plate is supported by a support plate, and the protection plate is electrically connected to the support plate through the exposure portion of the nozzle plate.

Such a configuration enables static charges to be removed from the nozzle plate with a simpler configuration and without providing a space for grounding.

In the ink jet head according to the present invention, the support plate and the protection plate are electrically connected to each other through a conductive resin.

Such a configuration enables the support plate and the protection plate to be easily electrically connected to each other. Thus, it is possible to more reliably reduce increases in the number of manufacturing steps and the manufacturing cost of the nozzle plate.

Further, reliable electrical connection between the support plate and the protection plate can be achieved. Thus, the operation of the actuator plate can be reliably stabilized.

The liquid jet recording apparatus includes any one of the above described ink jet head.

Such a configuration enables a liquid jet recording apparatus that makes it possible to remove static charges while reducing increases in the number of manufacturing steps and the manufacturing cost with a simple structure to be provided.

Further, a liquid jet recording apparatus that makes it possible to stabilize the operation, reduce an increase in the number of components, and achieve downsizing can be provided.

According to the present invention, a portion for grounding (a portion on which the protection plate is grounded) can be provided on the back face of the nozzle plate with a simple structure. That is, the protection plate can be grounded on the back face side of the nozzle plate through the exposure portion. Further, since grounding of the nozzle plate itself is not required, it is not necessary to form the nozzle plate using silicon as conventionally performed. Thus, it is possible to remove static charges from the nozzle plate while reducing increases in the number of manufacturing steps and the manufacturing cost.

Further, the grounding is performed using the back face side of the nozzle plate. Thus, a cover made of metal for covering the ink jet head is not required, and the size of the nozzle plate itself is not increased. Further, ink is not uniformly adhered to the portion for grounding (the portion in which the protection plate is exposed on the back face side of the nozzle plate). Thus, no short circuit occurs when the actuator plate is driven. Accordingly, it is possible to stabilize the operation of the ink jet head and reduce an increase in the number of components to downsize the ink jet head.

DETAILED DESCRIPTION

Next, an embodiment of the present invention will be described with reference to the drawings.

(Liquid Jet Recording Apparatus)

Figure 1:
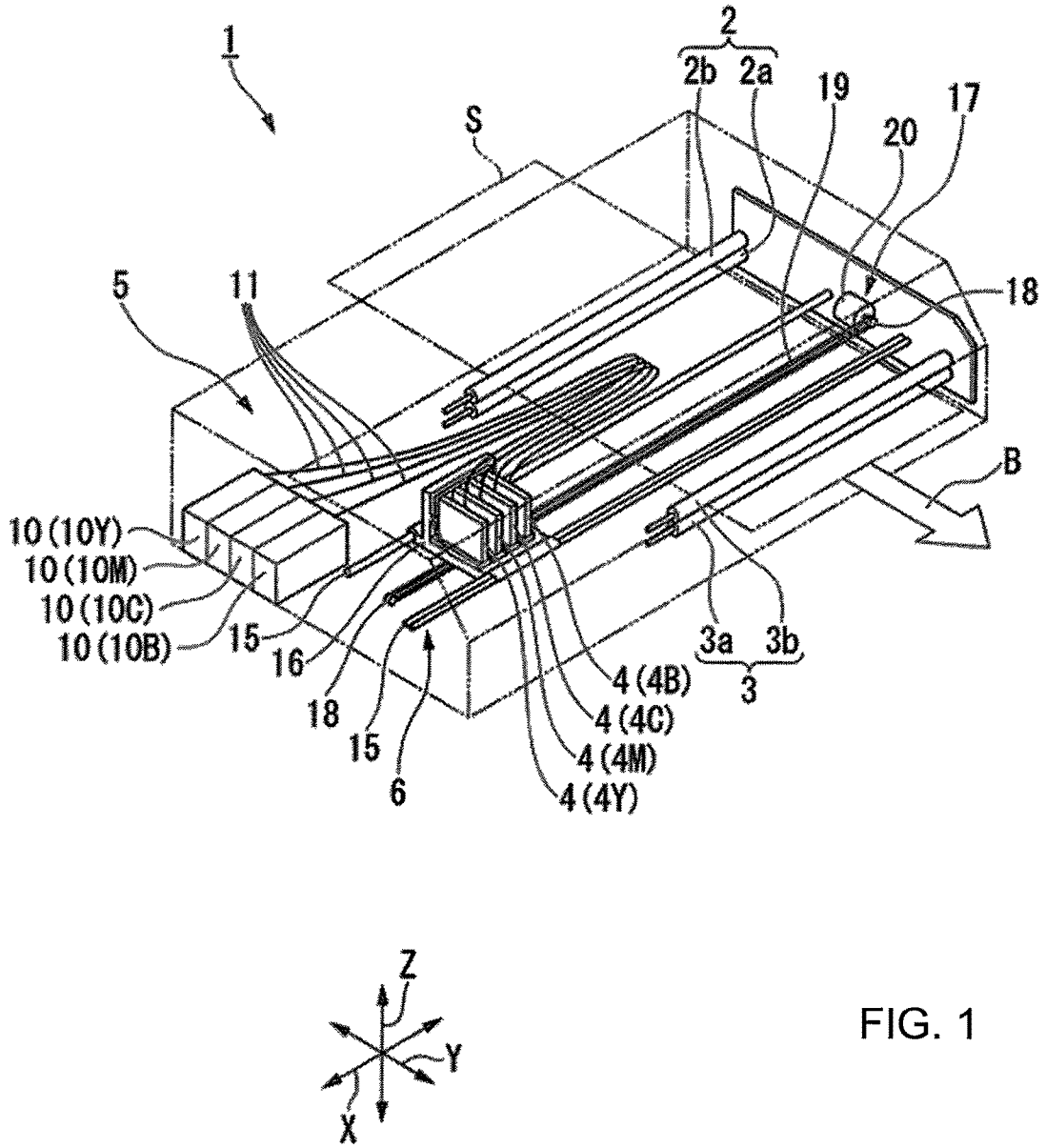
FIG. 1 is a perspective view illustrating the configuration of a liquid jet recording apparatus in an embodiment of the present invention.

FIG. 1 is a perspective view illustrating the configuration of a liquid jet recording apparatus 1. In the drawings used in the following description, the scale of each member is appropriately changed to facilitate understanding of the description.

As illustrated in FIG. 1, the liquid jet recording apparatus 1 is provided with a pair of conveyance units 2, 3 which conveys a recording medium S such as a recording paper, an ink jet head 4 which jets ink (not illustrated) onto the recording medium S, an ink supply unit 5 which supplies ink to the ink jet head 4, and a scanning unit 6 which moves the ink jet head 4 in a scanning direction X that is perpendicular to a conveyance direction Y of the recording medium S.

In the present embodiment, a direction that is perpendicular to both the conveyance direction Y and the scanning direction X is defined as an up-down direction Z.

The conveyance units 2, 3 are spaced apart from each other in the conveyance direction Y. The conveyance unit 2 on one side is located on the upstream side in the conveyance direction Y, and the conveyance unit 3 on the other side is located on the downstream side in the conveyance direction Y. The conveyance unit 2 is provided with a grid roller 2*a* which extends in the scanning direction X, a pinch roller 2*b* which is disposed parallel to the grid roller 2*a* and pinches the recording medium S between the pinch roller 2*b* and the grid roller 2*a*, and a drive mechanism (not illustrated), for example, a motor which rotates the grid roller 2*a* around an axis thereof. Similarly, the conveyance unit 3 is provided with a grid roller 3*a* which extends in the scanning direction X, a pinch roller 3*b* which is disposed parallel to the grid roller 3*a* and pinches the recoding medium S between the pinch roller 3*b* and the grid roller 3*a*, and a drive mechanism (not illustrated), for example, a motor which rotates the grid roller 3*a* around an axis thereof.

The recording medium S can be conveyed in a direction of an arrow B along the conveyance direction Y by rotating the grid rollers 2*a*, 3*a* of the pair of conveyance units 2, 3.

The ink supply unit 5 is provided with an ink tank 10 which stores ink therein and an ink tube 11 which connects the ink tank 10 to the ink jet head 4.

In the illustrated example, the ink tank 10 includes ink tanks 10Y, 10M, 10C, 10B which respectively store therein four colors of ink, specifically, yellow (Y) ink, magenta (M) ink, cyan (C) ink, and black (B) ink. The ink tanks 10Y, 10M, 10C, 10B are arranged side by side in the conveyance direction Y. The ink tube 11 is, for example, a flexible hose having flexibility and capable of following the action (movement) of a carriage 16 which supports the ink jet head 4.

The scanning unit 6 is provided with a pair of guide rails 15 which extend in the scanning direction X and are disposed parallel to each other with a space therebetween in the conveyance direction Y, the carriage 16 which is disposed movably along the pair of guide rails 15, and a drive mechanism 17 which moves the carriage 16 in the scanning direction X.

The drive mechanism 17 is provided with a pair of pulleys 18 which are disposed between the guide rails 15 and spaced apart from each other in the scanning direction X, an endless belt 19 which is wound around the pair of pulleys 18 and moves in the scanning direction X, and a drive motor 20 which drives one of the pulleys 18 to rotate.

The carriage 16 is coupled to the endless belt 19 and movable in the scanning direction X along with the movement of the endless belt 19 caused by driving one of the pulleys 18 to rotate. A plurality of ink jet heads 4 which are arranged side by side in the scanning direction X are mounted on the carriage 16.

In the illustrated example, four ink jet heads 4, specifically, inkjet heads 4Y, 4M, 4C, 4B which respectively jet yellow (Y) ink, magenta (M) ink, cyan (C) ink, and black (B) ink are mounted on the carriage 16.

(Ink Jet Head)

Next, the ink jet head 4 will be specifically described.

Figure 2:
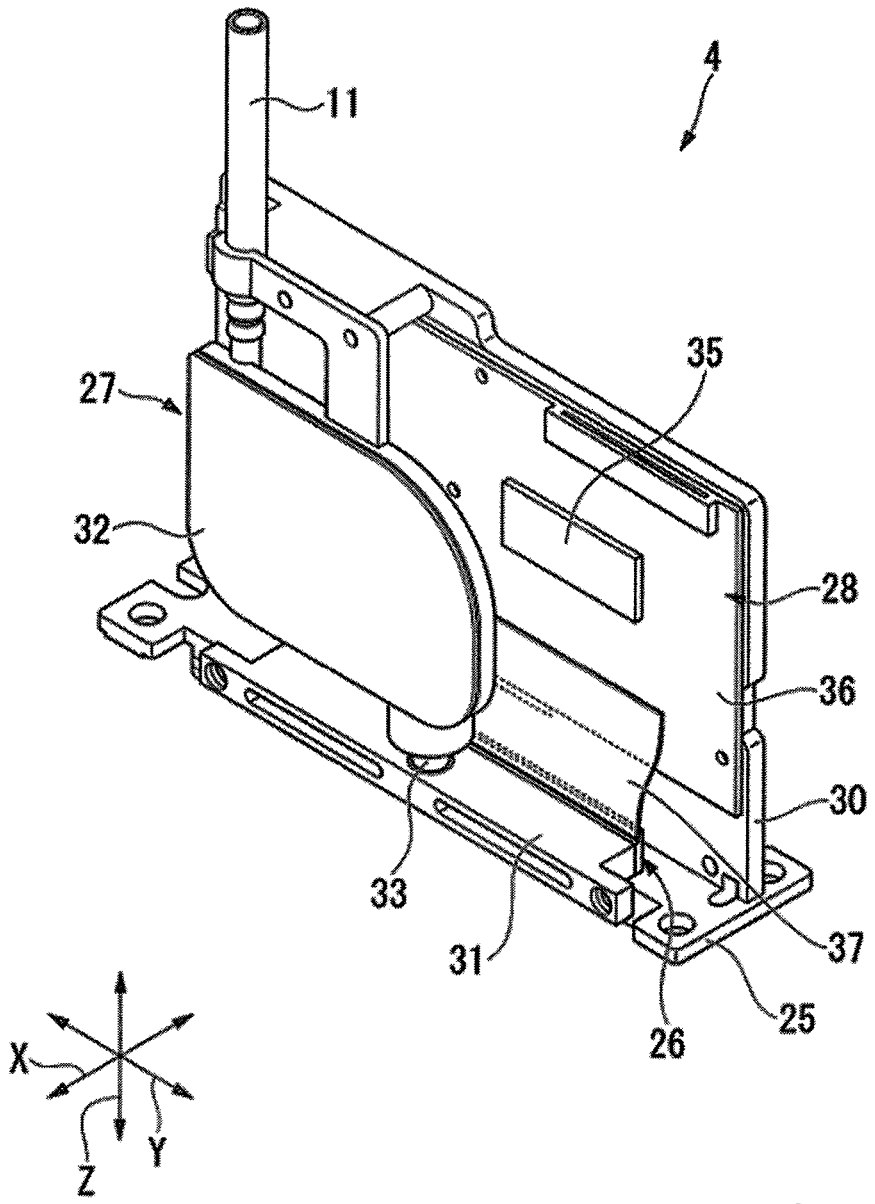
FIG. 2 is a perspective view of an ink jet head in the embodiment of the present invention.

FIG. 2 is a perspective view of the ink jet head 4.

As illustrated in FIG. 2, the inkjet head 4 is provided with a fixation plate 25 which is fixed to the carriage 16, a head chip 26 which is fixed onto the fixation plate 25, an ink supply portion 27 which supplies ink supplied from the ink supply unit 5 further to an ink introduction hole 41*a* (described below) of the head chip 26, and a control unit 28 which applies drive voltage to the head chip 26.

The ink jet head 4 ejects a predetermined amount of ink of the corresponding color by the application of drive voltage. At this point, the ink jet head 4 is moved in the scanning direction X by the scanning unit 6, which enables recording to be performed in a predetermined range of the recording medium S. Recording can be performed on the entire recording medium S by repeatedly performing the scanning while conveying the recording medium S in the conveyance direction Y by the conveyance units 2, 3.

A base plate 30 which is made of metal, for example, aluminum is fixed, in a standing state along the up-down direction Z, to the fixation plate 25. Further, a flow path member 31 which supplies ink to the ink introduction hole 41*a* (described below) of the head chip 26 is fixed to the fixation plate 25. A pressure buffer 32 which includes a storage chamber for storing ink inside thereof is supported by the base plate 30 above the flow path member 31. The flow path member 31 and the pressure buffer 32 are coupled to each other through an ink coupling tube 33. The ink tube 11 is connected to the pressure buffer 32.

In such a configuration, when ink is supplied to the pressure buffer 32 through the ink tube 11, the pressure buffer 32 temporarily stores the ink in the storage chamber inside thereof, and then supplies a predetermined amount of ink to the ink introduction hole 41*a* through the ink coupling tube 33 and the flow path member 31.

The flow path member 31, the pressure buffer 32, and the ink coupling tube 33 function as the ink supply portion 27 described above.

An IC board 36 is attached to the fixation plate 25. A control circuit (drive circuit) 35, for example, an integrated circuit for driving the head chip 26 is mounted on the IC board 36. The control circuit 35 is electrically connected to a common electrode (drive electrode) and a dummy electrode (both the electrodes are not illustrated) of the head chip 26 through a flexible board 37 having a wiring pattern (not illustrated) printed thereon. Accordingly, the control circuit 35 can apply drive voltage between the common electrode and the dummy electrode through the flexible board 37.

The IC board 36 having the control circuit 35 mounted thereon and the flexible board 37 function as the control unit 28 described above.

(Head Chip)

Next, the head chip 26 will be specifically described.

Figure 3:
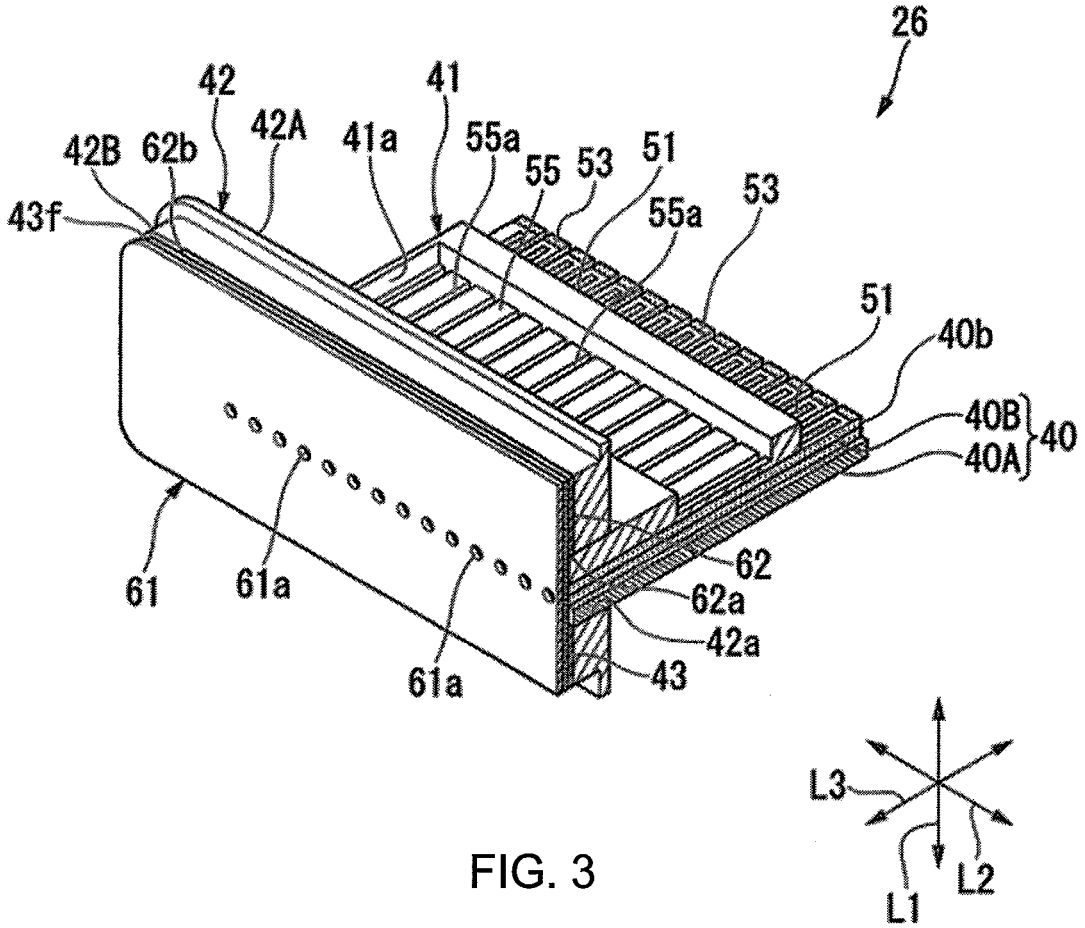
FIG. 3 is a perspective view of a head chip in the embodiment of the present invention.
Figure 4:
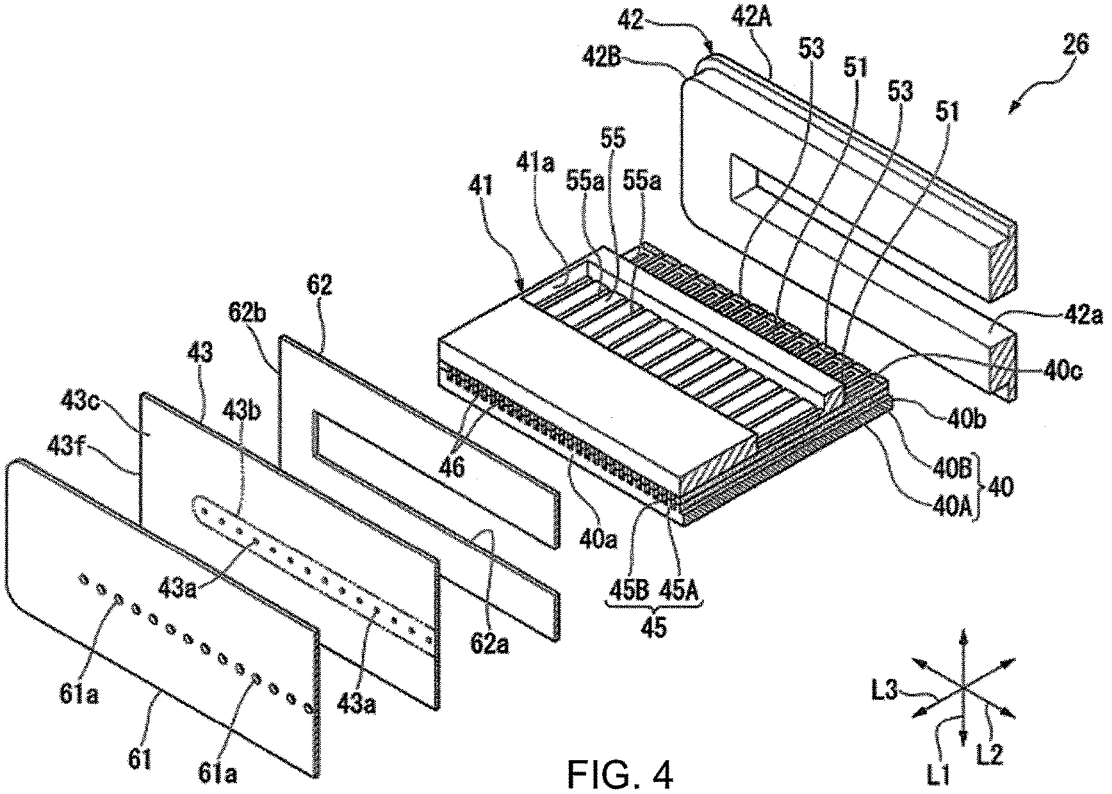
FIG. 4 is an exploded perspective view of the head chip in the embodiment of the present invention.

FIG. 3 is a perspective view of the head chip 26. FIG. 4 is an exploded perspective view of the head chip 26.

As illustrated in FIGS. 3 and 4, the head chip 26 is provided with an actuator plate 40, a cover plate 41, a support plate 42, a nozzle plate 43, a protection plate 61, and a reinforcing plate 62. The head chip 26 is an edge shoot type head chip which ejects ink from a nozzle hole 43*a* which faces a longitudinal end of a liquid jet channel 45A (described below).

The actuator plate 40 is a lamination plate which is formed by laminating two plates, specifically, a first actuator plate 40A and a second actuator plate 40B. The actuator plate 40 is not limited to a lamination plate, and may include a single plate.

The first actuator plate 40A and the second actuator plate 40B are piezoelectric substrates, for example, PZT (lead zirconate titanate) ceramic substrates both polarized in the thickness direction, and joined to each other with their polarized directions facing opposite sides.

The actuator plate 40 is formed in a substantially rectangular shape in plan view which is long in a first direction (array direction) L2 perpendicular to a thickness direction L1 and short in a second direction L3 perpendicular to both the thickness direction L1 and the first direction L2.

The head chip 26 of the present embodiment is an edge shoot type head chip. Thus, the thickness direction L1 corresponds to the scanning direction X in the liquid jet recording apparatus 1, the first direction L2 corresponds to the conveyance direction Y, and the second direction L3 corresponds to the up-down direction Z. That is, for example, in the actuator plate 40, a side face that faces the nozzle plate 43 (the side face at the ink ejection side) corresponds to a lower end face 40*a*, and a side face that is located opposite to the lower end face 40*a* in the second direction L3 corresponds to an upper end face 40*b*. In the following description, a side may be merely referred to as the lower side or the upper side in accordance with this up-down direction. However, it is needless to say that the up-down direction normally changes according to an installation angle of the liquid jet recording apparatus 1.

A plurality of channels 45 are formed on one principal face (a face covered with the cover plate 41) 40*c* of the actuator plate 40. The channels 45 are arranged side by side at predetermined intervals in the first direction L2. The channels 45 are grooves which are open on the principal face 40*c* and linearly extend along the second direction L3. One side in the longitudinal direction of each of the channels 45 is open on the lower end face 40*a* of the actuator plate 40. Drive walls (piezoelectric partition walls) 46 are formed between the channels 45. Each of the drive walls 46 has a substantially rectangular cross-sectional shape and extends in the second direction L3. The channels 45 are divided by the drive walls 46.

The channels 45 are roughly classified into liquid jet channels (liquid ejection grooves) 45A which are filled with ink and dummy channels (liquid non-ejection grooves) 45B which are not filled with ink. The liquid jet channels 45A and the dummy channels 45B are alternately arranged side by side in the first direction L2.

The liquid jet channels 45A are not open on the upper end face 40*b* of the actuator plate 40, but open only on the lower end face 40*a*. On the other hand, the dummy channels 45B are open not only on the lower end face 40*a* of the actuator plate 40, but also on the upper end face 40*b*.

A common electrode (not illustrated) is formed on an inner wall surface, that is, a pair of side wall surfaces facing each other in the first direction L2 and a bottom wall surface of each of the liquid jet channels 45A. The common electrode extends in second direction L3 along the liquid jet channel 45A and is electrically connected to a common terminal (electrode terminal portion) 51 which is formed on the principal face 40*c* of the actuator plate 40.

On the other hand, dummy electrodes (not illustrated) are formed on a pair of side wall surfaces facing each other in the first direction L2 in an inner wall surface of each of the dummy channels 45B. The dummy electrodes extend in the second direction L3 along the dummy channel 45B and are electrically connected to dummy terminals (electrode terminal portions) 53 which are formed on the principal face 40*c* of the actuator plate 40.

The dummy terminal 53 is formed on the principal face 40*c* of the actuator plate 40 at a position closer to the upper end face 40*b* than the common terminal 51 is. The dummy terminal 53 connects dummy electrodes located on both sides across the liquid jet channel 45A (dummy electrodes formed inside different dummy channels 45B) to each other.

In such a configuration, when the control circuit 35 applies, through the flexible board 37, drive voltage between the common electrodes and the dummy electrodes through the common terminals 51 and the dummy terminals 53, the drive walls 46 are deformed. Accordingly, pressure fluctuation occurs in ink filled inside the liquid jet channels 45A. Accordingly, the ink inside the liquid jet channels 45A can be ejected through the nozzle holes 43*a* to record various kinds of information such as characters or figures on the recording medium S.

The cover plate 41 is stacked on the principal face 40*c* of the actuator plate 40. The cover plate 41 includes the ink introduction hole 41*a* which is formed in a substantially rectangular shape in plan view elongated in the first direction L2.

The ink introduction hole 41*a* includes an ink introduction plate 55. The ink introduction plate 55 includes a plurality of slits 55*a* which introduce ink supplied through the flow path member 31 into the liquid jet channels 45A and restrict the introduction of ink into the dummy channels 45B. That is, the slits 55*a* are formed at positions corresponding to the respective liquid jet channels 45A to enable ink to be filled only into the liquid jet channels 45A.

The cover plate 41 is formed of, for example, a PZT ceramic substrate which is the same as the actuator plate 40 and thermally expanded in the same manner as the actuator plate 40 to reduce warpage or deformation caused by a temperature change. However, the cover plate 41 is not limited thereto and may be formed of a material different from the material of the actuator plate 40. However, a material having a thermal expansion coefficient close to that of the actuator plate 40 is preferably used.

The support plate 42 supports the actuator plate 40 and the cover plate 41 which are stacked and, at the same time, supports the nozzle plate 43. The support plate 42 is a substantially rectangular plate which is elongated in the first direction L2 so as to correspond to the actuator plate 40. The support plate 42 includes a fitting hole 42*a* which is formed in a large part of the center of the support plate 42 and penetrates the support plate 42 in the thickness direction. The fitting hole 42*a* is formed in a substantially rectangular shape along the first direction L2 and supports the stacked body of the actuator plate 40 and the cover plate 41 fitted inside the fitting hole 42*a*.

The support plate 42 is formed in a stepped plate-like shape in such a manner that the outer shape thereof becomes smaller toward the lower end in the thickness direction by the step. That is, the support plate 42 includes a base portion 42A which is located on the upper end side in the thickness direction and a step portion 42B which is located on the lower end face of the base portion 42A and has an outer shape smaller than the outer shape of the base portion 42A, the base portion 42A and the step portion 42B being integrally molded. The support plate 42 is combined with the actuator plate 40 in such a manner that the end face of the step portion 42B is recessed by a thickness T2 (refer to FIG. 6) of the reinforcing plate 62 with respect to the lower end face 40*a* of the actuator plate 40.

(Nozzle Plate)

The nozzle plate 43 with the protection plate 61 and the reinforcing plate 62 joined thereto is fixed to the end face of the step portion 42B, for example, with an adhesive.

The nozzle plate 43 is a sheet made of a film material, for example, polyimide and formed in a substantially rectangular shape elongated in the first direction L2.

The nozzle plate 43 includes a plurality of nozzle holes 43*a* which are formed at predetermined intervals in the first direction L2. The nozzle holes 43*a* are formed at positions facing the respective liquid jet channels 45A and arranged in a row to form a nozzle array 43*b*. Each of the nozzle holes 43*a* communicates with the corresponding liquid jet channel 45A. An appropriate meniscus is maintained in each of the nozzle holes 43*a* so as to prevent ink from being ejected from the nozzle hole 43*a* in a normal condition.

The protection plate 61 is disposed on an ejection face (a face opposite to the actuator plate 40) 43*c* of the nozzle plate 43 configured in this manner.

(Protection Plate)

Figure 5:
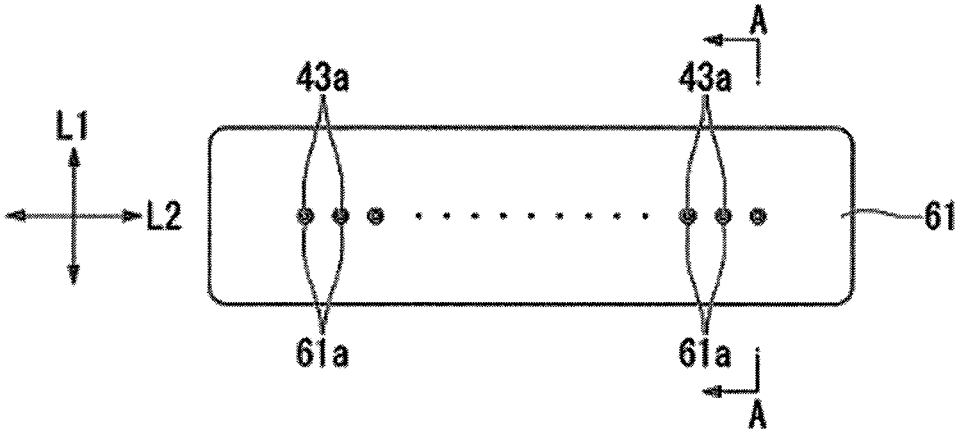
FIG. 5 is a plan view of a nozzle plate viewed from an ejection face in the embodiment of the present invention.
Figure 6:
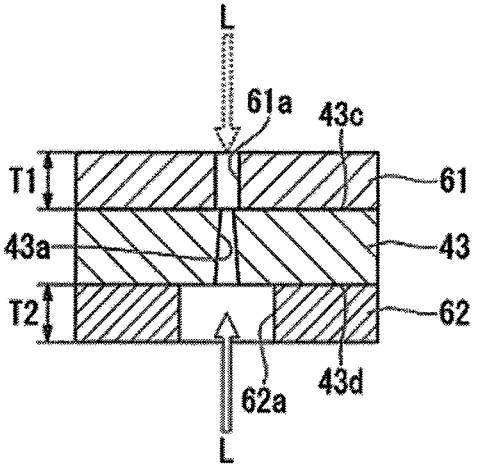
FIG. 6 is a sectional view taken along line A-A of FIG. 5.

FIG. 5 is a plan view of the nozzle plate 43 viewed from the ejection face 43*c*. FIG. 6 is a sectional view taken along line A-A of FIG. 5.

As illustrated in FIGS. 3 to 6, the protection plate 61 is used for protecting the nozzle plate 43 and preventing thermal deformation. The protection plate 61 is formed by applying pressing or etching to a thin-plate material made of stainless steel. The protection plate 61 is adhered and fixed to the ejection face 43*c* of the nozzle plate 43 by thermocompression bonding or bonding using an adhesive. The protection plate 61 is also formed in a substantially rectangular shape elongated in the first direction L2.

A water-repellent film is desirably applied to the surface of the protection plate 61 at the side opposite to the nozzle plate 43. Accordingly, it is possible to reduce residual ink adhered to the protection plate 61. However, the protection plate 61 is not limited to this configuration. The surface of the protection plate 61 located opposite to the nozzle plate 43 may have a hydrophilic property.

The protection plate 61 includes through holes 61*a* which are formed at positions corresponding to the respective nozzle holes 43*a* and penetrate the protection plate 61 in the thickness direction. The diameter of the through hole 61*a* is set to be slightly larger than the diameter of the nozzle hole 43*a*. The thickness T1 of the protection plate 61 is set to a thickness that prevents the formation of a meniscus of ink in the through holes 61*a*.

On the other hand, the reinforcing plate 62 is disposed on a back face 43*d* of the nozzle plate 43, the back face 43*d* being located opposite to the ejection face 43*c* (at the side facing the actuator plate 40).

(Reinforcing Plate)

Figure 7:
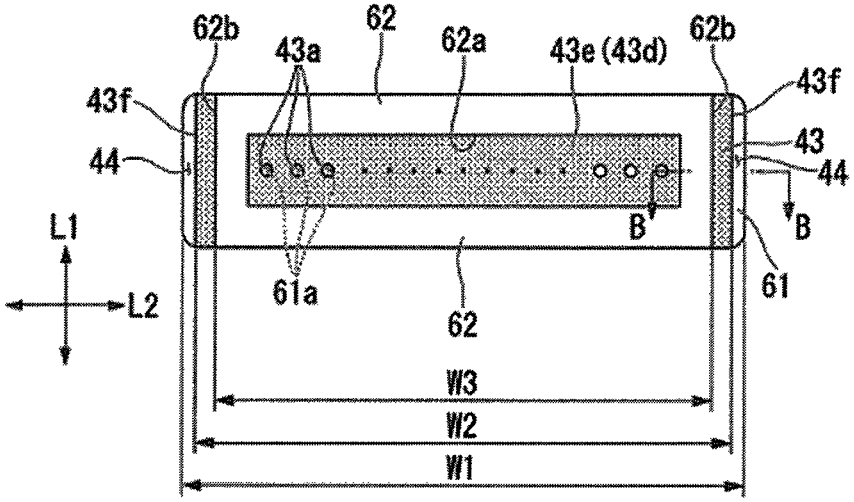
FIG. 7 is a plan view of the nozzle plate viewed from a back face in the embodiment of the present invention.
Figure 8:
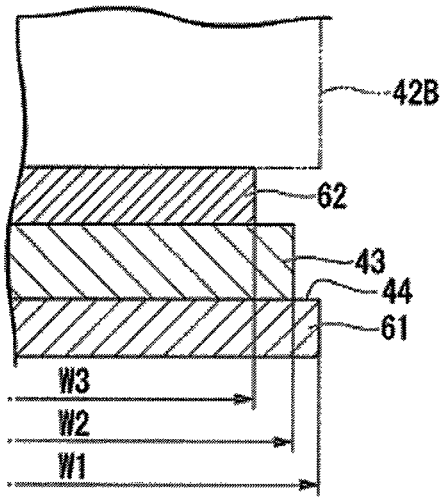
FIG. 8 is a sectional view taken along line B-B of FIG. 7.

FIG. 7 is a plan view of the nozzle plate 43 viewed from the back face 43*d*. FIG. 8 is a sectional view taken along line B-B of FIG. 7.

In the back face 43*d* of the nozzle plate 43, an area corresponding to the lower end face 40*a* of the actuator plate 40 (refer to a dot-hatched portion in FIG. 7) serves as an actuator joining face 43*e* joined to the lower end face 40*a*.

As illustrated in FIGS. 3, 4, 6 to 8, the reinforcing plate 62 is used for reinforcing the nozzle plate 43 to prevent warpage of the nozzle plate 43. The reinforcing plate 62 is formed by applying pressing or etching to a thin-plate material made of stainless steel. The reinforcing plate 62 is adhered and fixed to the back face 43*d* of the nozzle plate 43 by thermocompression bonding or bonding using an adhesive.

The reinforcing plate 62 is also formed in a substantially rectangular shape elongated in the first direction L2. The reinforcing plate 62 includes an opening 62*a* which is formed at a position corresponding to the actuator joining face 43*e* of the nozzle plate 43. That is, the reinforcing plate 62 avoids the actuator joining face 43*e* of the nozzle plate 43 and surrounds the periphery of the actuator joining face 43*e*. Accordingly, the actuator joining face 43*e* of the nozzle plate 43 is joined to the lower end face 40*a* of the actuator plate 40, and the reinforcing plate 62 is joined to the end face of the step portion 42B of the support plate 42.

The lower end face 40*a* of the actuator plate 40 and the actuator joining face 43*e* of the nozzle plate 43 are joined together using an adhesive. The end face of the step portion 42B of the support plate 42 and the reinforcing plate 62 are joined together using an adhesive. Thus, the surface of the reinforcing plate 62 desirably has a hydrophilic property.

The thickness T2 of the reinforcing plate 62 is desirably set to be larger than the thickness T1 of the protection plate 61. Setting the thickness T2 in this manner enables the stiffness of the reinforcing plate 62 to be increased and enables the influence of the protection plate 61 on the nozzle plate 43 to be minimized.

The lengths in the short-side direction (the lengths in the thickness direction L1 of the actuator plate 40) of the nozzle plate 43, the protection plate 61, and the reinforcing plate 62 are set to be substantially equal to the length in the short-side direction of the step portion 42B of the support plate 42 (the length in the thickness direction L1 of the actuator plate 40). On the other hand, the lengths in the longitudinal direction (the first direction L2) of the nozzle plate 43, the protection plate 61, and the reinforcing plate 62 differ from each other.

More specifically, as illustrated in FIGS. 7 and 8, the longitudinal length W1 of the protection plate 61 is set to be substantially equal to the length in the longitudinal direction (the first direction L2) of the step portion 42B of the support plate 42.

On the other hand, the longitudinal length W2 of the nozzle plate 43 is set to be slightly shorter than the longitudinal length W1 of the protection plate 61. The longitudinal length W3 of the reinforcing plate 62 is set to be slightly shorter than the longitudinal length W2 of the nozzle plate 43.

Steps are formed at both longitudinal ends when these plates 43, 61, 62 are stacked by forming each of the plates 43, 61, 62 in this manner. That is, when the nozzle plate 43 is viewed from the back face 43*d*, the longitudinal ends of the nozzle plate 43 are exposed from the longitudinal ends of the reinforcing plate 62, and the longitudinal ends of the protection plate 61 are exposed from the longitudinal ends of the nozzle plate 43. In other words, exposure portions 44 through which the protection plate 61 is exposed are formed on the longitudinal ends of the back face 43*d* of the nozzle plate 43.

When each of the plates 43, 61, 62 is adhered to the end face of the step portion 42B with an adhesive at the side corresponding to the back face 43*d* of the nozzle plate 43, the longitudinal ends of the protection plate 61, the longitudinal ends of the nozzle plate 43, and the longitudinal ends of the reinforcing plate 62 come into contact with the step portion 42B.

When the plates 43, 61, 62 are stacked, the steps are formed on the longitudinal ends of the stacked body. However, the thickness of each of the plates 43, 61, 62 is set to be small enough to ignore the steps. Further, the longitudinal ends of each of the plates 43, 61, 62 are more easily bent than the short-side ends thereof. Thus, the longitudinal ends of the protection plate 61, the longitudinal ends of the nozzle plate 43, and the longitudinal ends of the reinforcing plate 62 come in contact with the step portion 42B of the support plate 42.

The protection plate 61 is grounded by the contact of the protection plate 61 with the support plate 42. Although the reinforcing plate 62 made of metal is also in contact with the support plate 42 similarly to the protection plate 61, the nozzle plate 43 made of resin is interposed between the protection plate 61 and the reinforcing plate 62 at the longitudinal ends of each of the plates 43, 61, 62. Thus, the protection plate 61 has no direct contact with the reinforcing plate 62. The longitudinal length W2 of the nozzle plate 43 and the longitudinal length W3 of the reinforcing plate 62 are set to lengths that ensure an insulation distance between the protection plate 61 and the reinforcing plate 62.

An insulating adhesive such as an epoxy-based adhesive is used to fix the end face of the step portion 42B of the support plate 42 to each of the plates 43, 61, 62.

Even when an insulating adhesive is used, the film thickness of the adhesive between the support plate 42 and the protection plate 61 can be reduced to a film thickness that enables electrical connection between the plates 42, 61 (the film thickness smaller than the insulation distance) by strongly pressing the longitudinal ends of the protection plate 61 against the step portion 42B of the support plate 42. Instead of this, part of the adhesive is pushed away by strongly pressing part of the longitudinal ends of the protection plate 61, so that the protection plate 61 and the support plate 42 are brought into direct contact with each other.

Alternatively, when the end face of the step portion 42B of the support plate 42 is adhered and fixed to each of the plates 43, 61, 62, a conductive adhesive or a conductive resin may be used only on the longitudinal ends of the protection plate 61 (areas corresponding to the exposure portions 44 in the protection plate 61), and an insulating epoxy-based adhesive may be used on the nozzle plate 43 and the reinforcing plate 62. Such a configuration enables the support plate 42 and the protection plate 61 to be easily electrically connected.

In such a configuration, when information is recorded on the recording medium S by the liquid jet recording apparatus 1, as illustrated in FIG. 1, for example, the scanning unit 6 reciprocates each of the ink jet heads 4 in the scanning direction X through the carriage 16 while conveying the recording medium S in the conveyance direction Y by the pair of conveyance units 2, 3. During this operation, the control circuit 35 applies drive voltage between the common terminals 51 and the dummy terminals 53 in each of the ink jet heads 4.

The voltage application produces thickness-shear deformation in the drive walls 46 to generate pressure waves in ink filled inside the liquid jet channels 45A. The pressure waves increase the internal pressure of the liquid jet channels 45A. Thus, the ink can be ejected through the nozzle holes 43*a*. At this time, the ink is formed into ink droplets in the form of liquid droplets when passing through the nozzle holes 43*a* and ejected through the through holes 61*a* of the protection plate 61. As a result, various kinds of information such as characters or figures can be recorded on the recording medium S using four colors of ink.

The protection plate 61 is attached to the nozzle plate 43. The protection plate 61 is formed of stainless steel having a small thermal deformation amount. Thus, even when the nozzle plate 43 is formed of a resin such as polyimide, thermal deformation of the nozzle holes 43*a* can be reliably reduced. Thus, the amount of ink ejected from the head chip 26 can be stabilized regardless of the environmental temperature. As a result, recording on the recording medium S can be performed with high accuracy.

Further, the protection plate 61 may be charged by rubbing against the recording medium S. However, since the protection plate 61 is in contact with (electrically connected to) the step portion 42B of the support plate 42 and grounded, static charges are removed from the protection plate 61. Thus, the ink ejection characteristics are stabilized. As a result, the quality of various kinds of information such as characters or figures recorded on the recording medium S is stabilized.

(Method for Manufacturing Nozzle Plate, Protection Plate, and Reinforcing Plate)

Next, a method for manufacturing the nozzle plate 43, the protection plate 61, and the reinforcing plate 62 will be described with reference to FIGS. 6, 9A and 9B.

Figure 9A:
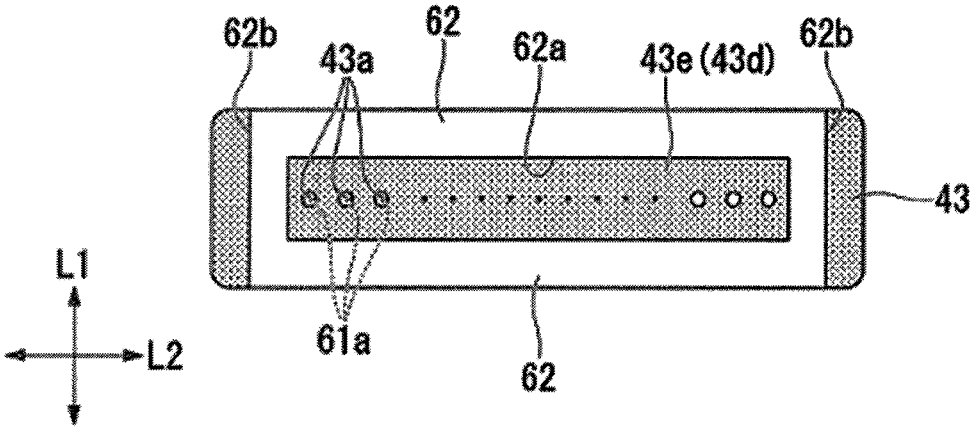
FIGS. 9A and 9B are explanatory diagrams illustrating steps of a method for manufacturing the nozzle plate, a protection plate, and a reinforcing plate in the embodiment of the present invention.
Figure 9B:
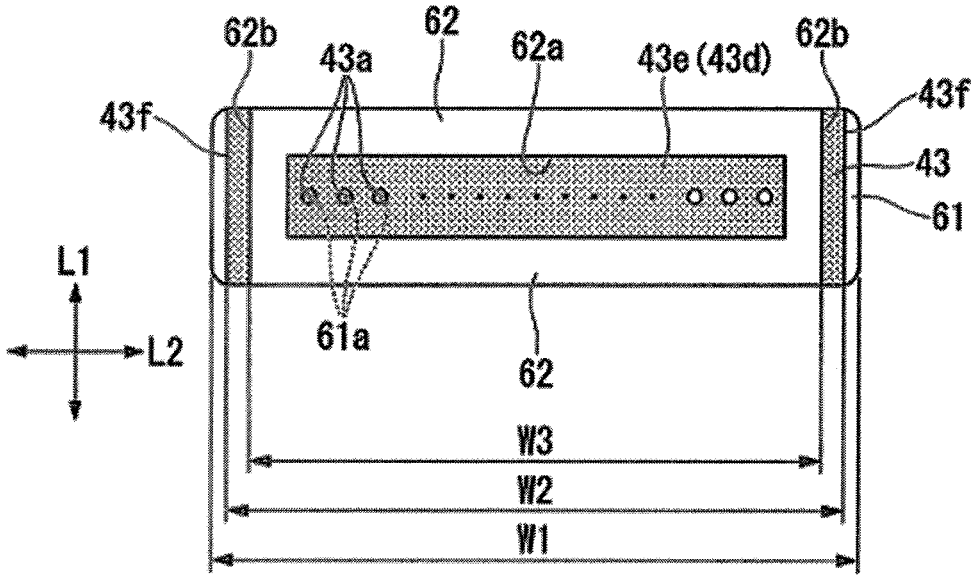

FIGS. 9A and 9B are explanatory diagrams illustrating steps of the method for manufacturing the nozzle plate 43, the protection plate 61, and the reinforcing plate 62.

First, the protection plate 61 is adhered to the ejection face 43*c* of the nozzle plate 43 by thermocompression bonding or bonding using an adhesive, and the reinforcing plate 62 is adhered to the back face 43*d* of the nozzle plate 43 by thermocompression bonding or bonding using an adhesive. At this point, the through holes 61*a* have not yet been formed on the protection plate 61, and the opening 62*a* has not yet been formed on the reinforcing plate 62. Further, the nozzle plate 43, the protection plate 61, and the reinforcing plate 62 all have the same shape. That is, the longitudinal lengths of the nozzle plate 43, the protection plate 61, and the reinforcing plate 62 are all set to the same length.

Next, as illustrated in FIG. 9A, the through holes 61*a* are formed on the protection plate 61 by etching. Further, the opening 62*a* is formed on the reinforcing plate 62, and cutout portions 62*b* are formed on the longitudinal ends of the reinforcing plate 62 to form the longitudinal length W3 of the reinforcing plate 62 into a desired length. Accordingly, the longitudinal ends of the nozzle plate 43 are exposed to the reinforcing plate 62.

Then, as illustrated in FIG. 9B, cutout portions 43*f* are formed on the longitudinal ends of the nozzle plate 43 by etching to form the longitudinal length W2 of the nozzle plate 43 into a desired length to form the exposure portions 44. Accordingly, the longitudinal ends of the protection plate 61 are exposed to the back face 43*d* of the nozzle plate 43 through the exposure portions 44.

Then, as illustrated in FIG. 6, a laser light L is applied to the nozzle plate 43 to form the nozzle hole 43*a* coaxial with the through hole 61*a*. At this point, the laser light L may be applied to the nozzle plate 43 from the back face 43*d* (refer to a solid arrow in FIG. 6) or from the protection plate 61 through the through hole 61*a* (refer to a broken arrow in FIG. 6).

The nozzle plate 43 is heated by the laser light L. However, since the protection plate 61 is adhered to the nozzle plate 43, thermal deformation of the nozzle plate 43 is reduced. Accordingly, the nozzle holes 43*a* are accurately formed. After the formation of the nozzle holes 43*a*, the manufacture of the nozzle plate 43, the protection plate 61, and the reinforcing plate 62 is completed.

Then, the nozzle plate 43 with the protection plate 61 and the reinforcing plate 62 adhered thereto is joined to the actuator plate 40 and the support plate 42 using an adhesive.

The reinforcing plate 62 is attached to the nozzle plate 43. Thus, even when the protection plate 61 is adhered to the entire area of the ejection face 43*c* of the nozzle plate 43, warpage of the nozzle plate 43 can be reduced. Thus, the nozzle plate 43 can be easily and correctly joined to the actuator plate 40 and the support plate 42.

The through holes 61*a* of the protection plate 61, the opening 62*a* and the cutout portions 62*b* of the reinforcing plate 62, and the cutout portions 43*f* of the nozzle plate 43 may also be formed using a laser light instead of etching. In this case, for example, the cutout portions 43*f* may be formed simultaneously with the step of forming the nozzle holes 43*a* of the nozzle plate 43. Such a manufacturing method enables the number of manufacturing steps of the nozzle plate 43 to be reduced.

As described above, in the above embodiment, the cutout portions 43*f* are formed on the nozzle plate 43 to form the exposure portions 44, and the longitudinal ends of the protection plate 61 are exposed to the back face 43*d* of the nozzle plate 43 through the exposure portions 44. Further, the exposed portions of the protection plate 61 are brought into contact with the step portion 42B of the support plate 42. Thus, static charges can be easily removed from the protection plate 61 without providing a conventionally-provided complicated conductive portion and without providing a space for grounding the protection plate 61.

Further, since grounding of the nozzle plate 43 itself is not required, it is not necessary to form the nozzle plate 43 using silicon as conventionally performed. Thus, it is possible to remove static charges from the nozzle plate 43 while reducing increases in the number of manufacturing steps and the manufacturing cost.

Further, the grounding is performed using the back face 43*d* of the nozzle plate 43. Thus, a conventional cover made of metal for covering the ink jet head 4 is not required, and the size of the nozzle plate 43 itself is not increased. Further, ink is not uniformly adhered to the exposed portion of the protection plate 61. Thus, no short circuit occurs when the actuator plate 40 is driven. Accordingly, it is possible to stabilize the operation of the ink jet head 4 and reduce an increase in the number of components to downsize the ink jet head 4.

The cutout portions 43*f* are formed on the longitudinal ends of the nozzle plate 43 to form the exposure portions 44, and the longitudinal ends of the protection plate 61 are brought into contact with the support plate 42. The longitudinal ends are more easily bent than the short-side ends. Thus, the protection plate 61 can be easily brought into contact with the support plate 42 using the easiness in bending.

Further, it is not necessary to ensure a space for the contact with the support plate 42 in the short-side direction of the protection plate 61. Thus, the nozzle plate 43, the protection plate 61, and the reinforcing plate 62 can be thinned in the short-side direction (the thickness direction L1 of the actuator plate 40). As a result, even when a plurality of ink jet heads 4 are arranged side by side in the scanning direction X (refer to FIG. 1), the arrangement space for these ink jet heads 4 can be reduced.

When a conductive adhesive or a conductive resin is used to adhere the protection plate 61 and the support plate 42 together, reliable electrical connection between the protection plate 61 and the support plate 42 can be achieved. Thus, the operation of the actuator plate 40 can be reliably stabilized. Further, since the protection plate 61 and the support plate 42 can be easily electrically connected to each other, increases in the number of manufacturing steps and the manufacturing cost of the nozzle plate 43, the protection plate 61, and the reinforcing plate 62 can be more reliably reduced.

In the above embodiment, the cutout portions 62*b* are formed on both the longitudinal ends of the protection plate 61, the cutout portions 43*f* are formed on both the longitudinal ends of the nozzle plate 43, and the exposure portions 44 which expose the protection plate 61 are formed on the back face 43*d* of the nozzle plate 43. However, the present invention is not limited to this configuration. The cutout portion 62*b* may be formed only on one longitudinal end of the protection plate 61, and the cutout portion 43*f* may be formed only on one longitudinal end of the nozzle plate 43.

(First Modification)

Next, a first modification of the present embodiment will be described with reference to FIG. 10. In the following description, the same mode as the above embodiment will be designated by the same reference sign and description thereof will be omitted (the same applies also to the following modification).

Figure 10:
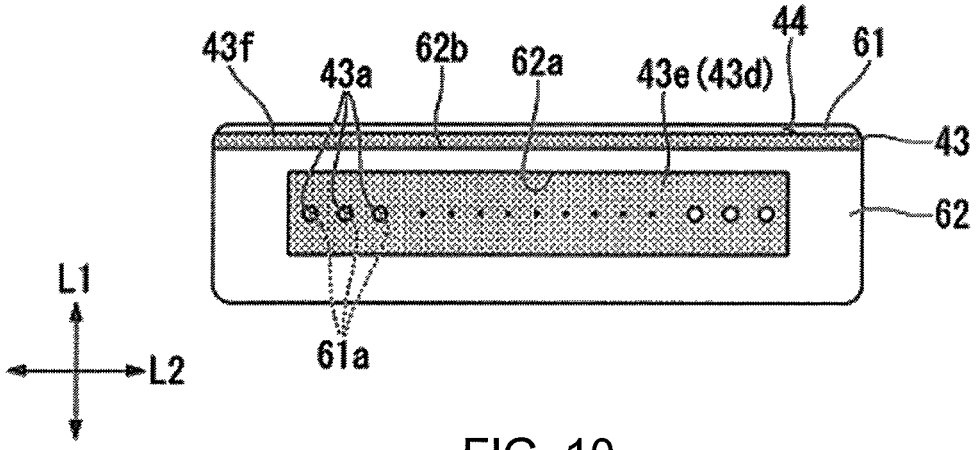
FIG. 10 is a plan view of a nozzle plate viewed from a back face in a first modification of the embodiment of the present invention.

FIG. 10 is a plan view of a nozzle plate 43 viewed from a back face 43*d* in the first modification and corresponds to FIG. 7 of the above embodiment.

In the above embodiment, the cutout portions 62*b* are formed on both the longitudinal ends of the reinforcing plate 62, and the cutout portions 43*f* are formed on both the longitudinal ends of the nozzle plate 43. However, in the first modification, a cutout portion 62*b* is formed on one short-side end of the reinforcing plate 62, and a cutout portion 43*f* is formed on one short-side end of the nozzle plate 43 as illustrated in FIG. 10. The first modification differs from the above embodiment in this point.

In the reinforcing plate 62, the cutout portion 62*b* is formed on a short-side end at a side corresponding to the cover plate 41 (refer to FIGS. 3 and 4) (the upper end in FIG. 10). In the nozzle plate 43, the cutout portion 43*f* is formed on a short-side end at a side corresponding to the cover plate 41 (refer to FIGS. 3 and 4) (the upper end in FIG. 10). Accordingly, an exposure portion 44 is formed on the short-side end of the nozzle plate 43 at the side corresponding to the cover plate 41.

Such a configuration also enables the protection plate 61 and the step portion 42B of the support plate 42 to make contact with each other. Thus, an effect similar to the effect of the above embodiment is achieved.

When the cutout portion 62*b* is formed in the short-side direction of the reinforcing plate 62 and the cutout portion 43*f* is formed in the short-side direction of the nozzle plate 43 in this manner, the contact area between the protection plate 61 and the support plate 42 can be separated from the actuator plate 40 as much as possible by forming the cutout portions 62*b*, 43*f* on the ends at the side corresponding to the cover plate 41. Thus, it is possible to prevent electricity from flowing to the actuator plate 40 from the protection plate 61 and to stabilize the operation of the actuator plate 40.

(Second Modification)

Next, a second modification of the present embodiment will be described with reference to FIG. 11.

Figure 11:
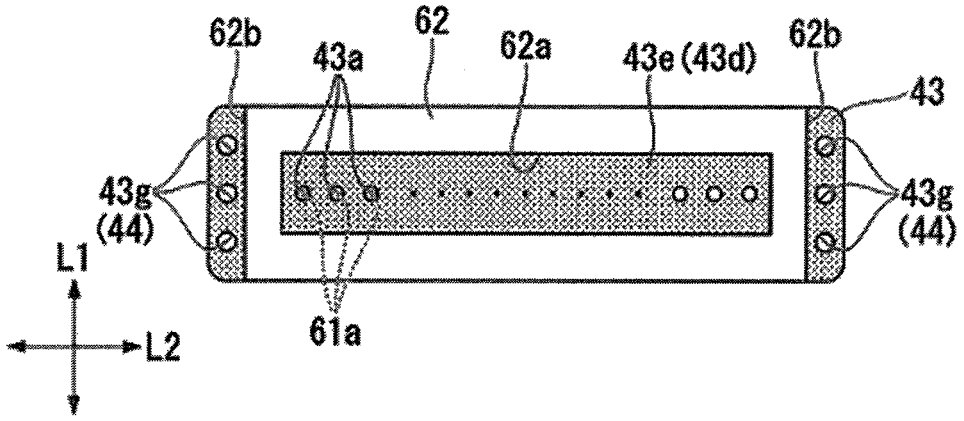
FIG. 11 is a plan view of a nozzle plate viewed from a back face in a second modification of the embodiment of the present invention.

FIG. 11 is a plan view of a nozzle plate 43 viewed from a back face 43*d* in the second modification and corresponds to FIG. 7 of the above embodiment.

In the above embodiment, the cutout portions 62*b* are formed on both the longitudinal ends of the reinforcing plate 62, and the cutout portions 43*f* are formed on both the longitudinal ends of the nozzle plate 43. However, in the second modification, cutout portions 62*b* are formed on both longitudinal ends of the reinforcing plate 62, and a plurality of openings 43*g* are formed on both longitudinal ends of the nozzle plate 43 as illustrated in FIG. 11. In other words, the longitudinal ends of the nozzle plate 43 are partially cut out (cutout portions are formed) to form the openings 43*g* to form exposure portions 44. The second modification differs from the above embodiment in this point.

Such a configuration also enables the protection plate 61 and the step portion 42B of the support plate 42 to make contact with each other. Thus, an effect similar to the effect of the above embodiment is achieved.

In the second modification, a conductive adhesive or a conductive resin is desirably applied to the openings 43*g* (exposure portions 44) to reliably bring the protection plate 61 exposed through the openings 43*g* into contact with the support plate 42.

The present invention is not limited to the above embodiment and includes one obtained by adding various modifications to the above embodiment without departing from the gist of the invention.

For example, in the above embodiment, the reinforcing plate 62 is disposed on the back face 43*d* of the nozzle plate 43. However, the present invention is not limited to this configuration, and the reinforcing plate 62 may not be provided.

In the above embodiment, the protection plate 61 which is exposed to the back face 43*d* of the nozzle plate 43 through the exposure portions 44 is brought into contact with the support plate 42 to ground the protection plate 61. However, the present invention is not limited to this configuration. The protection plate 61 which is exposed to the back face 43*d* of the nozzle plate 43 through the exposure portions 44 may be grounded on the carriage 16 or the base plate 30 through a conductive member. Also in this case, it is not necessary to dispose a component for removing static charges around the protection plate 61 except the back face. Thus, it is possible to prevent an increase in the size of the ink jet head 4.

In the above embodiment, in the manufacture of the nozzle plate 43, the protection plate 61, and the reinforcing plate 62, the protection plate 61 and the reinforcing plate 62 both having the same shape as the nozzle plate 43 are adhered to the respective faces of the nozzle plate 43, and the protection plate 61 and the reinforcing plate 62 are then formed into desired shapes by etching. However, the present invention is not limited to this method. The protection plate 61 and the reinforcing plate 62 may be previously formed into desired shapes and then adhered to the nozzle plate 43.

In the above embodiment, the outer shape of the protection plate 61 is formed in a substantially rectangular shape elongated in the first direction L2 so as to correspond to the outer shape of the nozzle plate 43. However, the present invention is not limited to this configuration. The outer shape of the protection plate 61 may be any shape that enables the nozzle plate 43 to be protected, enables thermal deformation of the nozzle plate 43 to be prevented, and enables the protection plate 61 to be exposed to the back face 43*d* of the nozzle plate 43 through the exposure portions 44. Further, the exposure position 44 may be disposed on any position in the nozzle plate 43 other than a joining face 43*e* of the nozzle plate 43 with the actuator plate 40.

In the above embodiment, the protection plate 61 and the reinforcing plate 62 are formed of thin-plate materials made of stainless steel. However, the present invention is not limited to this configuration. Various materials made of metal may be employed as the protection plate 61 and the reinforcing plate 62.

In the above embodiment, the head chip 26 is an edge shoot type head chip that ejects ink through the nozzle hole 43*a* facing the longitudinal end of the liquid jet channel 45A. However, the present invention is not limited to this configuration. The protection plate 61 and the reinforcing plate 62 may be employed to a side shoot type head chip that ejects ink through a nozzle hole facing a longitudinal center of the liquid jet channel 45A.

In the above embodiment, the thickness T2 of the reinforcing plate 62 is set to be larger than the thickness T1 of the protection plate 61. However, the present invention is not limited to this configuration. The thickness T2 of the reinforcing plate 62 and the thickness T1 of the protection plate 61 may be set to be equal to each other or the same level.

What is claimed is:

1. An ink head comprising:

a nozzle plate having an ejection face and a back face opposite one another, and a nozzle array comprised of a plurality of nozzle holes;

an actuator plate including a plurality of channels filled with ink and communicating with respective nozzle holes;

a support plate that supports the actuator plate; and a protection plate disposed on the ejection face of the nozzle plate from which the ink is ejected, the protection plate including through holes formed at positions corresponding to respective nozzle holes and communicating with the nozzle holes, wherein the back face of the nozzle plate has an exposure portion configured to expose the protection plate at a position other than a joining face of the nozzle plate that joins the nozzle plate with the actuator plate, and the protection plate is electrically connected to the support plate through the exposure portion of the nozzle plate.

2. The ink jet head according to claim 1, wherein the nozzle plate and the protection plate are formed in a rectangular shape elongated along the nozzle array, and the exposure portion is formed on a longitudinal end of the nozzle plate.

3. The ink jet head according to claim 1, wherein the nozzle plate and the protection plate are formed in a rectangular shape elongated along the nozzle array, the actuator plate is formed in a rectangular parallelepiped shape, the channels are open on a first face of the actuator plate to which the nozzle plate is joined and open on a second face intersecting the first face, a cover plate configured to partially block openings of the channels and including an ink introduction portion communicating with the channels is disposed on the second face of the actuator plate, and the exposure portion is formed on a short-side end of the nozzle plate at a side corresponding to the cover plate.

4. The ink jet head according to claim 1, wherein the support plate and the protection plate are electrically connected to each other through a conductive resin.

5. A liquid jet recording apparatus comprising the ink jet head according to claim 1.

* * * * *